US006037856A

United States Patent [19]

Aizawa

[11] Patent Number: 6,037,856

[45] Date of Patent: Mar. 14, 2000

[54] ROTATING ELECTRICAL COMPONENT HAVING ROTARY LOCK MECHANISM OF OPERATING SHAFT

[75] Inventor: Seiji Aizawa, Miyagi-ken, Japan

[73] Assignee: Alps Electric Co., Ltd., Japan

[21] Appl. No.: 09/246,742

[22] Filed: Feb. 8, 1999

[30] Foreign Application Priority Data

Feb. 19, 1998 [JP] Japan ..... 10-037057

[51] Int. Cl.[7] ..... H01C 10/32

[52] U.S. Cl. ..... 338/162; 338/160; 338/163; 338/167; 338/170

[58] Field of Search ..... 338/160, 162, 338/163, 167, 170, 199

[56] References Cited

U.S. PATENT DOCUMENTS 4,251,796 2/1981 Soeda et al. ..... 338/176
4,353,053 10/1982 Matsui et al. ..... 338/184
4,363,018 12/1982 Matsui et al. ..... 338/172
4,721,939 1/1988 Prestel ..... 338/162

FOREIGN PATENT DOCUMENTS 63-18095 5/1988 Japan .

*Primary Examiner*—Lincoln Donovan
*Assistant Examiner*—Richard K. Lee
*Attorney, Agent, or Firm*—Brinks Hofer Gilson & Lione

[57] ABSTRACT

A rotating electrical component, in which, on mating surface sides of the flange of the support member and the flange of the operating shaft, on both sides of the center of rotation on the line which passes through the center of rotation of the operating shaft, there are provided projections and recesses which differ in diameter measured from the center of rotation of the operating shaft and can be engaged and disengaged in positions where they will not overlap each other in the circumferential direction.

8 Claims, 7 Drawing Sheets

ROTATING ELECTRICAL COMPONENT HAVING ROTARY LOCK MECHANISM OF OPERATING SHAFT

BACKGROUND OF THE INVENTION

1. Field of the Invention

The present invention relates to a rotating electrical component, such as a variable resistor, rotary encoder, etc., suitable for use in such an electric cooking appliance as an electric range.

2. Description of Related Art

In a conventional portable electronic equipment such as a radio receiver, a transceiver, etc., if the power switch is carelessly pressed to on and the user does not notice it, battery power will be wasted. To obviate the above-described disadvantage, a switch described below has been disclosed in Japanese Utility Model Publication No. Sho 63-18095.

In the switch disclosed in Japanese Utility Model Publication No. Sho 63-18095, as shown in FIGS. 12 and 13, a cylindrical support member 31 is comprised of a projecting piece 32 mounted on the outer peripheral portion for operating the switch, a projection-recess portion 33, a flange 34 formed on the inside surface, and a pair of recesses 35 mutually facing on both sides of the shaft hole and formed in the lower surface of the flange so as to be positioned on the circumference of the same diameter.

The sliding member 36 has a small-diameter shaft 37, a large-diameter shaft 38, a flange 39 located between the small-diameter shaft 37 and the large-diameter shaft 38, and a pair of projections 40 formed on the upper surface of the flange 39 in opposite positions on both sides of the small-diameter shaft 37.

The sliding member 36 is inserted in the support member 31. In this state the sliding member 36 thus installed is rotatable and axially movable. And the pair of projections 40 can be engaged with, and disengaged from, the pair of recesses 35.

Furthermore the sliding member 36 thus installed is pressed against the flange 34 of the support member 31 by the force of a spring 42 interposed between a bottom member 41 and the flange 39.

Above the sliding member 36 are mounted a knob 43 and a push member 44, and furthermore a ball 46 loaded with a spring 45 is placed oppositely to the projection-recess portion 33 of the support member 31, thereby constituting a click mechanism.

The switch operation stated above first presses the push member 44 against the force of the spring 42 to move the slide member 36 in the axial direction, disengaging the projection 40 from the recess 35, and thereafter the knob 43 is turned to turn the slide member 36 to thereby rotate the support member 31.

Then, the support member 31 is operated with a click by the click mechanism and the projecting piece 32 rotates to change over the contact of the switch not shown.

As the knob 43 is turned back to the original position, the slide member 36 also moves back to engage the projection 40 with the recess 35.

That is, the switch is first pushed and then turned so as not to be carelessly operated to on.

The above-described conventional switch has such a disadvantage that because the pair of recesses 35 and the projections 40 are formed on a circumference of the same diameter, the projection 40 is engaged with the recess 35 within the 180-degree range of rotation of the slide member 36; and accordingly the slide member 36 has a narrow operation range.

The bottom member 41 is needed beside the slide member 36 to install the spring 42, which increases components count and cost, resulting in low productivity.

Furthermore, there is such a drawback that the support member 31, being designed to be rotated, needs a member for supporting itself, thereby increasing the components count; and moreover on the outer periphery of the support member 31 the projecting piece 32 is formed for switch operation or the projection-recess portion 33 is provided as the click mechanism, making the structure large and complicated.

SUMMARY OF THE INVENTION

It is, therefore, an object of the present invention to provide, as a first means for obviating the above-described drawback, a rotating electrical component which has a support member having a flange, an operating shaft rotatably and axially movably mounted on the support member and having a flange, and a spring member for pressing the operating shaft to the flange side of the support member. On mating surface sides of the flange of the support member and the flange of the operating shaft, and on both sides of the center of rotation on the line which passes through the center of rotation of the operating shaft, there are provided projections and recesses which differ in diameter measured from the center of rotation of the operating shaft and can be engaged and disengaged in positions where they will not overlap each other in the circumferential direction, so that the projections will be disengaged from the recesses when the operating shaft is moved axially against the force of the spring member, thereby enabling rotation of the operating shaft.

It is another object of the present invention to provide, as a second means for obviating the above-described drawback, a rotating electrical component in which either one of the flange of the support member and the flange of the operating shaft is provided with recesses on both sides of the center of rotation of the operating shaft and in positions where the diameter from the center of rotation of the operating shaft differs, and the other flange is provided with projections which engage with, and disengage from, the recesses.

Another object of the present invention is to provide, as a third means for obviating the above-described drawback, a rotating electrical component in which the flange of the support member is provided, on both sides of the center of rotation of the operating shaft, with a recess in either one of positions where diameter from the center of rotation of the operating shaft differs, and with a projection in the other position; also the flange of the operating shaft is provided with a projection which can engage with the recess of the flange and a recess in which the projection of the flange engages.

Another object of the present invention is to provide, as a fourth means for obviating the above-described drawback, a rotating electrical component in which the operating shaft and the flange are unitarily formed by molding a synthetic resin.

Another object of the present invention is to provide, as a fifth means for obviating the above-described drawback, a rotating electrical component in which a rotating body holding a contact member is provided; the rotating body and the operating shaft being splined, so that the rotating body can be rotated by turning the operating shaft; and furthermore the spring member is interposed between the operating shaft and the rotating body.

Another object of the present invention is to provide, as a sixth means for obviating the above-described drawback, a rotating electrical component in which a spring for clicking disposed between the rotating body and the support member is attached to the rotating body or to the support member, so that the operating shaft will rotate with a click.

Another object of the present invention is to provide, as a seventh means for obviating the above-described drawback, a rotating electrical component in which a rotatable coding member comprising a magnet and others is provided; the coding member being splined to the operating shaft to rotate the coding member with the rotation of the operating shaft. Furthermore, a spring member is interposed between the operating shaft and the coding member.

Further another object of the present invention is to provide, as an eighth means for obviating the above-described drawback, a rotating electrical component in which the spring for clicking disposed between the coding member and the support member is attached to the coding member or to the support member, to thereby provide the rotation of the operating shaft with a click motion.

BRIEF DESCRIPTION OF THE DRAWINGS

The above and other objects, features and advantages of the present invention will be clear from the following description with reference to the accompanying drawings in which.

DESCRIPTION OF THE PREFERRED EMBODIMENTS

The rotating electrical component of the first embodiment according to the present invention will be described with reference to FIG. 1 to FIG. 7. A support member 1 of a rectangular box type produced of a synthetic resin molding has a plate-like flange 1*a*, a hole 1*b* provided at the center of the flange 1*a*, a side wall 1*c* extending downwardly from the periphery of the flange 1*a*, a depressed portion 1*e* having a projection 1*d* formed on the inner peripheral surface on the hole 1*b* side of the inside surface of the flange 1*a*, a depressed portion 1*g* positioned in the outer periphery of the depressed portion 1*e* and having a projection 1*f*, and a flat portion 1*k* positioned further in the outer periphery of the depressed portion 1*g* and having a projection-recess portion 1*h*.

Figure 4:
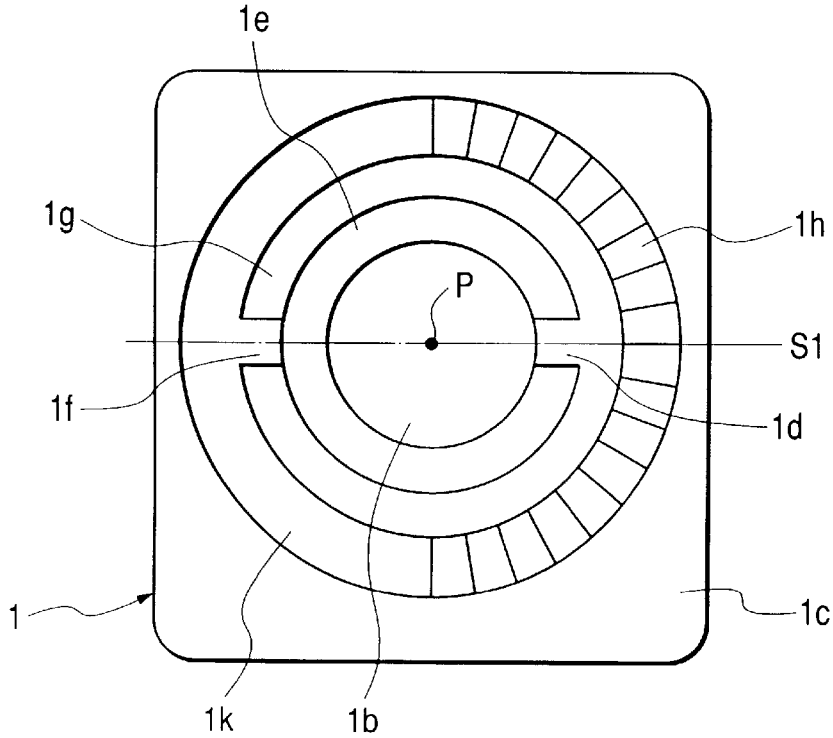
FIG. 4 is a lower surface of a support member according to the first embodiment.

The projections 1*d* and 1*f*, as shown in FIG. 4, differ in diameter from the center P of the hole 1*b* on both sides (180 degrees apart) of the center P of the line S1 passing through the center P of the hole 1*b*, and are so formed as not to overlap in the circumferential direction. Furthermore, the projection-recess portion 1*h* is formed within the range of about 180 degrees of the flat portion 1*k*.

The projection-recess portion 1*h* may be formed throughout the range of 360 degrees.

The operating shaft produced of a synthetic resin molding is provided with a shaft portion 2*a*, a flange 2*b* formed unitarily with the shaft portion 2*a* in a stepped form, a pair of recesses 2*c* and 2*d* provided at the flange 2*b*, a depressed portion 2*e* provided around the shaft portion 2*a*, and a projection 2*f* formed on the underside of the flange 2*b*.

Figure 5:
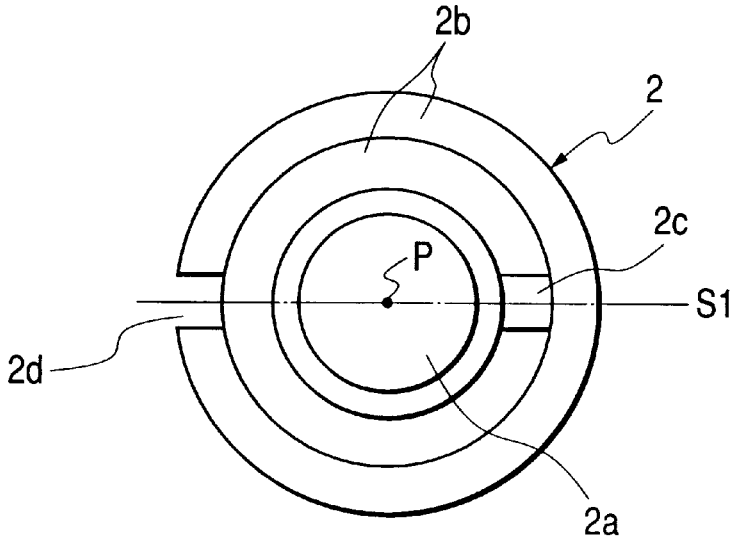
FIG. 5 is a plan view of an operating shaft according to the first embodiment.
Figure 6:
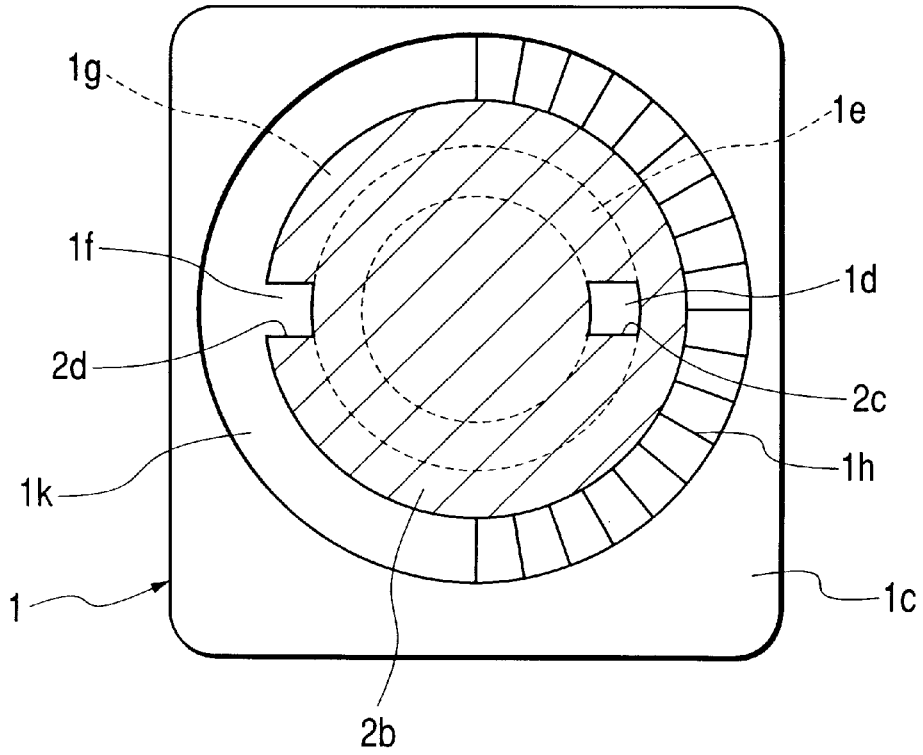
FIG. 6 is an explanatory view showing the assembly of the support member and the operating shaft according to the first embodiment.

The recesses 2*c* and 2*d*, as shown in FIG. 5, are formed on both sides (180 degrees apart) of the center P of rotation of the line S1 passing through the center P of rotation of the operating shaft 2, different in diameter from the center P of rotation of the operating shaft 2, in positions in which they will not overlap in the circumferential direction.

The operating shaft 2, with its shaft portion 2*a* inserted in the hole 1*b* of the support member 1, is rotatably and axially movably installed to the support member 1; when the operating shaft 2 is installed, the recess 2*c* can be engaged with the projection 1*d*, while the recess 2*d* can be engaged with the projection 1*f*.

In the present embodiment, the support member 1 is provided with the projections 1*d* and 1*f*, and the operating shaft 2 with the recesses 2*c* and 2*d*. The support member 1 may be provided with recesses, and the operating shaft 2 with projections.

The rotating body 3 comprising an insulating material has a noncircular hole 3*a* provided at a central part, a projection 3*b* provided on the upper surface, and a depressed portion 3*c* provided also on the upper surface.

The rotating body 3 is housed in the support member 1 and the operating shaft 2 is inserted in the hole 3*a*; in this state the rotating body 3 and the operating shaft 2 are splined, so that with the rotation of the operating shaft 2 the rotating body 3 will rotate simultaneously. Furthermore the rotating body 3 is assembled with the depressed portion 3*c* opposite to the projection 2*f* of the operating shaft 2.

Figure 3:
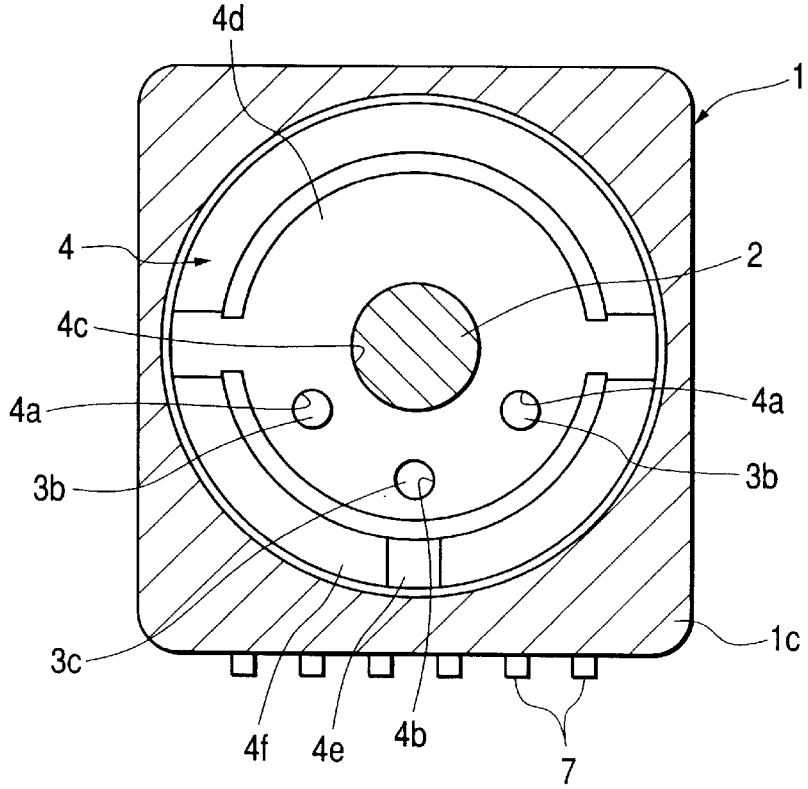
FIG. 3 is a sectional view taken along line 3—3 of FIG. 2.

The circular spring 4 for clicking which is a metal plate spring has a base portion 4*d* provided with holes 4*a*, 4*b* and 4*c*, an engagement portion 4*e*, and an arm portion 4*f* extending from the base portion 4*d* as shown in FIG. 3.

Figure 1:
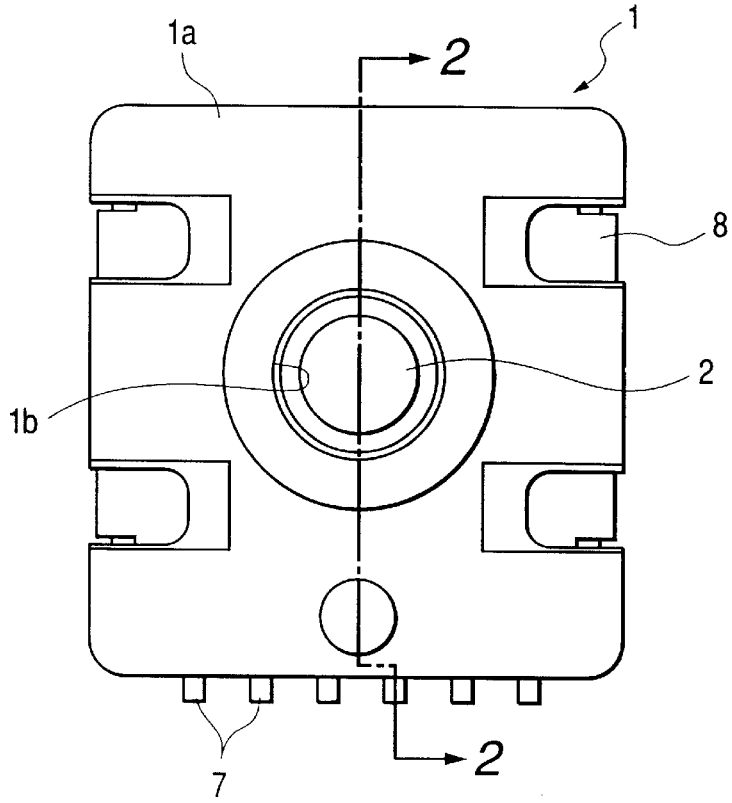
FIG. 1 is a plan view of the first embodiment.
Figure 2:
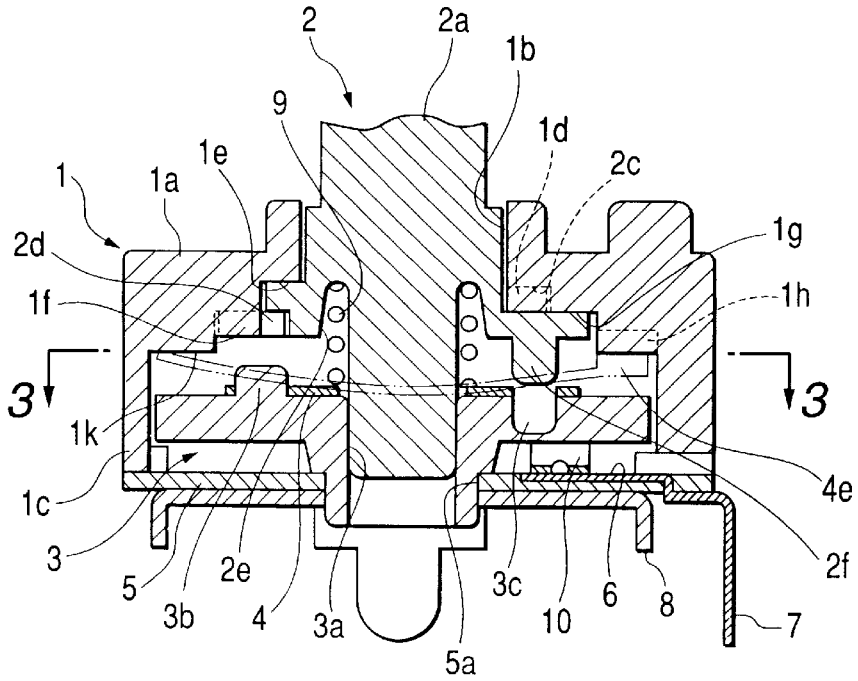
FIG. 2 is a sectional view thereof.

The spring 4 for clicking is mounted on the upper surface of the rotating body 3, with the projection 3*b* inserted in the hole 4*a*, and then attached to the rotating body 3 with the forward end of the projection 3*b* pressed down. Also when the spring 4 for clicking is mounted in the support member 1, the operating shaft 2 is mounted through in the hole 4*c* as shown in FIG. 2, and is disposed between the support member 1 and the rotating body 3. In this state, the hole 4*b* faces the projection 2*f* of the operating shaft 2, and the engagement portion 4*e* is engaged with the projection-recess portion 1*h* of the support member 1.

The spring 4 for clicking in the present embodiment is attached to the rotating body 3, but may be attached to the support member 1. In this case, the projection-recess portion in engagement with the spring 4 for clicking is required only to be provided on the rotating body 3 side.

The insulating base plate 5 has a hole 5*a* formed at the central part, and is provided with an embedded contact portion or a conductor 6 such as a resistor, and with a terminal 7 connected to the conductor 6.

Then, with the rotating body 3 partly inserted in the hole 5*a*, the insulating base plate 5 is mounted under the side wall 1*c* of the support member 1, and is attached to the support member 1 by a mounting plate 8.

A coil-shaped spring member 9 is inserted onto the operating shaft 2 for mounting between the operating shaft 2 and the rotating body 3. Thus the spring member 9 presses the operating shaft 2 towards the support member 1 side, and the rotating body 3 against the insulating base plate 5.

A contact member 10 comprising a metal plate spring is mounted on the underside of the rotating body 3, and the contact member 10 rotates together with the rotating member 3, thereby contacting, and releasing from, the conductor 6 such as a contact portion, or sliding on the conductor 6 such as the resistor.

Figure 7A:
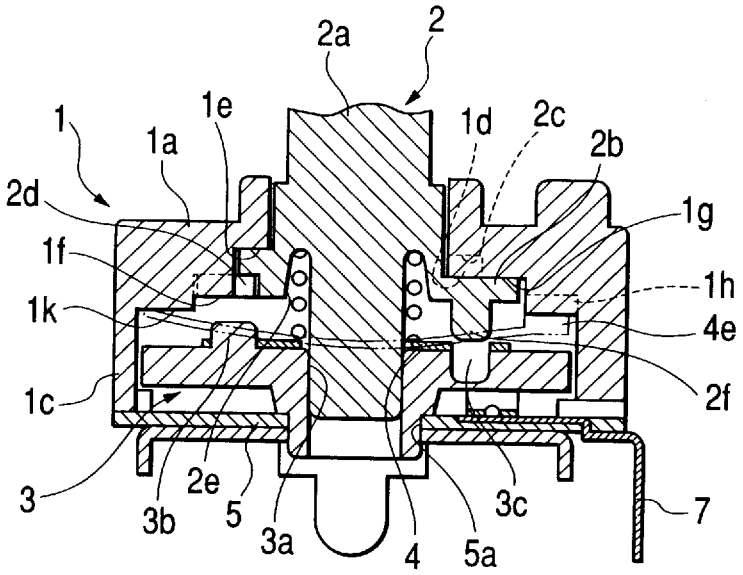
FIGS. 7A–C, are views explaining operation of the first embodiment.
Figure 7B:
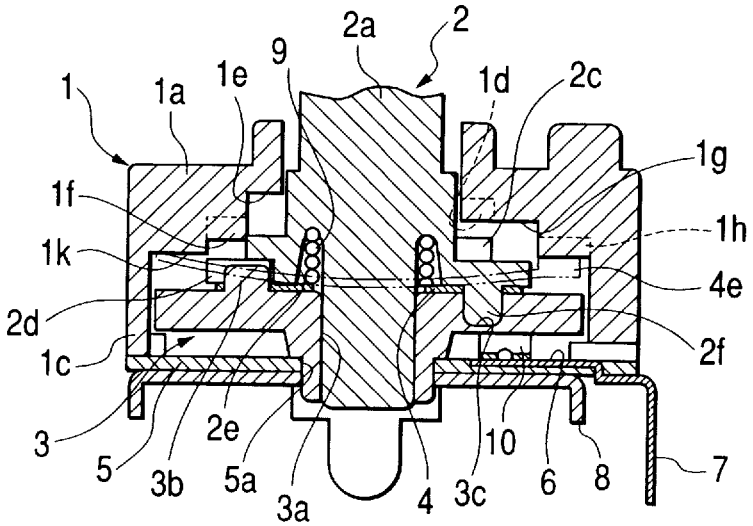

Next, operation of the rotating electrical component will be described with reference to FIG. 7. FIG. 7A shows the projections 1*d* and 1*f* of the support member 1 are engaged with the recesses 2*c* and 2*d* of the operating shaft 2. In this state, when the operating shaft 2 is pressed axially against the force of the spring member 9, the projections 1*d* and 1*f* come off from the recesses 2*c* and 2*d* as shown in FIG. 7B; in this state the operating shaft 2 is rotatable and the projection 2*f* of the operating shaft 2 fits in the depressed portion 3*c* of the rotating body 3.

As the operating shaft 2 is turned in this state, the rotating body 3 rotates together with the operating shaft 2, to make the contact member 10 slide on the conductor 6, thereby adjusting the electrical component. Also with the rotation of the rotating body 3, the spring 4 for clicking moves up and down on the projection-recess portion 1*h* of the support member 1, thereby actuating the operating shaft 2 with a click motion.

Figure 7C:
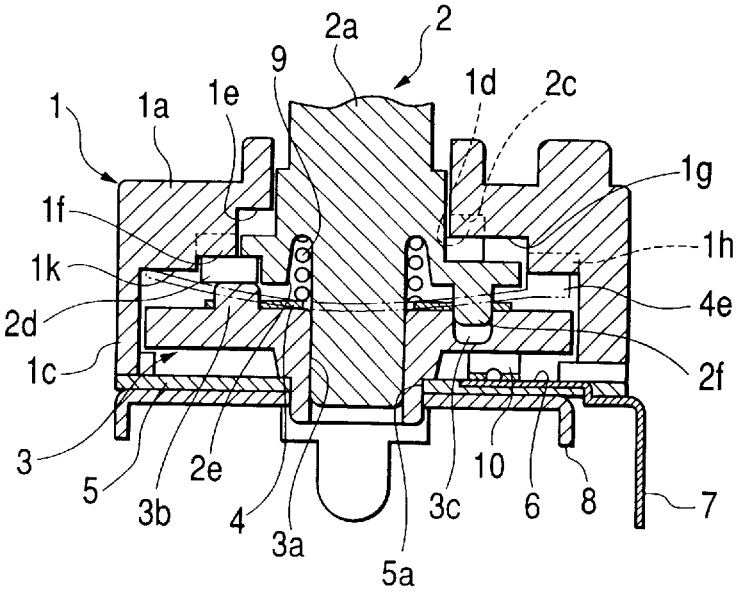

When the operating shaft 2 is turned a little, the flange 2*b* of the operating shaft 2 rides on the projections 1*d* and 1*f* of the support member 1 as shown in FIG. 7C, releasing the push of the operating shaft 2 to allow the operating shaft 2 to rotate.

The projections 1*d* and 1*f* and the recesses 2*c* and 2*d*, so arranged as not to mutually overlap in the circumferential direction if the operating shaft 2 is turned through 180 degrees, will not be engaged. The operating shaft 2, when turned through 360 degrees, is pushed by the spring member 9 to engage the projections 1*d* and 1*f* with the recesses 2*c* and 2*d* respectively.

When the projections 1*d* and 1*f* are engaged with the recesses 2*c* and 2*d*, the electrical component is in the state shown in FIG. 7A. In this state, the operating shaft 2 will not turn if a force is applied to turn because the projections 1*d* and 1*f* are in engagement with the recesses 2*c* and 2*d*.

In the present embodiment, the operating shaft 2 makes a click motion from the projection 1*d* as the original point within the range of 90 degrees in the clockwise or counterclockwise direction.

The operating shaft 2 can properly turn without tilting because the projections 1*d* and 1*f* are provided on both sides of the center P of rotation.

In the present embodiment, since the recesses 2*c* and 2*d* are open on the outer peripheral side, it is unnecessary to allow a large amount of radial deviation for the purpose of proper engagement, and accordingly it is possible to decrease a radial dimension.

Further in the present embodiment, the projections 1*d* and 1*f* are connected with the depressed portion 1*g* and the flat portion 1*k* surface, thereby providing a greater strength.

Figure 8:
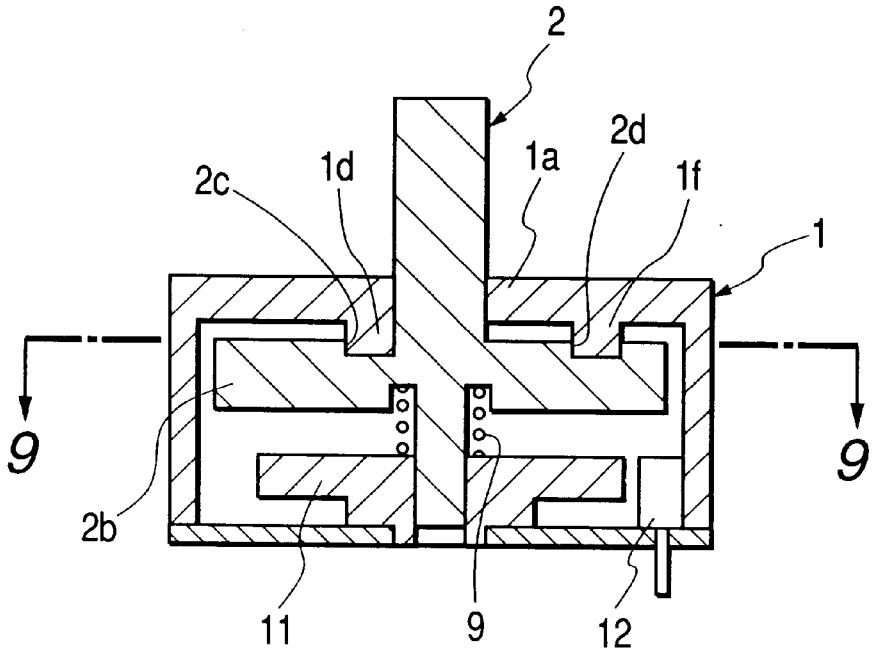
FIG. 8 is a sectional view of the second embodiment.
Figure 9:
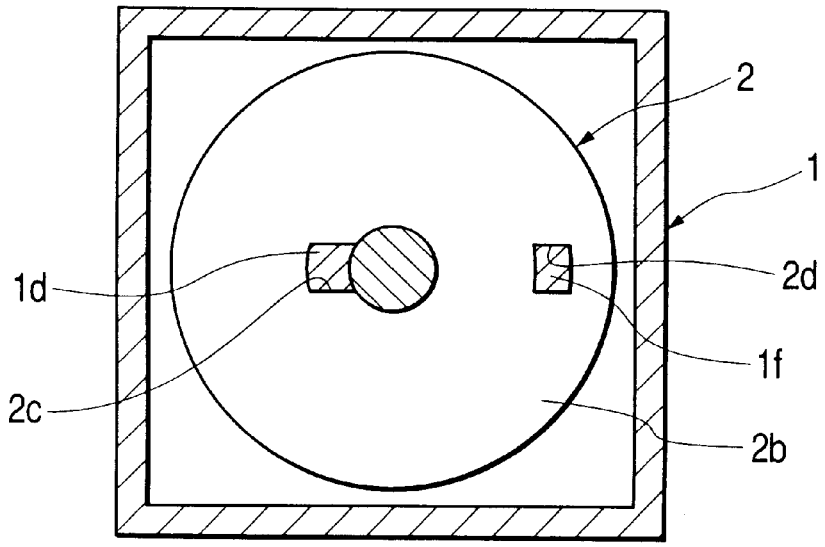
FIG. 9 is a sectional view taken along line 9—9 of FIG. 8.

FIG. 8 and FIG. 9 show the second embodiment of the rotating electrical component according to the present invention. The present embodiment is the embodiment applied to the rotary encoder, in which the flange 1*a* of the support member 1, similarly to the aforesaid embodiment, differs in diameter from the center P of rotation of the operating shaft 2, on both sides (in positions 180 degrees apart) of the center P of rotation of the line S1 passing through the center P of rotation of the operating shaft 2, and the projections 1*d* and 1*f* are formed in positions not overlapping in the circumferential direction.

The flange 2*b* of the operating shaft 2 is provided with the recesses 2*c* and 2*d*, which differ in diameter from the center P of rotation of the operating shaft 2, on both sides (in positions 180 degrees apart) of the center P of rotation of the line S1 passing through the center P of rotation of the operating shaft 2, and are not overlapped in the circumferential direction.

The recesses 2*c* and 2*d* can be engaged with the projections 1*d* and 1*f*.

The coding member 11 consisting of a magnet and others is splined to the operating shaft 2, and mounted rotatable together with the operating shaft 2. Between the coding member 11 and the operating shaft 2 the spring member 9 is disposed to constantly press the operating shaft 2 towards the flange 1*a* side.

Oppositely to the coding member 11 a detecting sensor 12 is disposed to detect the magnet. The detecting sensor 12 is designed to detect the rotation of the coding member 11.

The operation of the rotary encoder mentioned above is similar to the aforesaid embodiment. The projections 1*d* and 1*f* of the support member fit in the recesses 2*c* and 2*d* of the operating shaft 2; in this state of engagement of the projections in the recesses, when the operating shaft 2 is pushed axially against the force of the spring member 9, the projections 1*d* and 1*f* come off from the recesses 2*c* and 2*d*, thereby allowing the operating shaft 2 to rotate.

When the operating shaft is turned in this state, the coding member 11 turns together with the operating shaft 2, detecting the code by the detecting sensor 12.

When the operating shaft 2 is turned a little, the flange 2*b* of the operating shaft 2 rides on the projections 1*d* and 1*f* of the support member 1, thereby releasing the push of the operating shaft to allow the rotation of the operating shaft 2.

The projections 1*d* and 1*f* and the recesses 2*c* and 2*d*, so arranged not to be mutually overlapped in the circumferential direction, will not be engaged if the operating shaft 1 is turned through 180 degrees. The operating shaft 2 is pushed by the spring member 9 when turned through 360 degrees, where the projections 1*d* and 1*f* are engaged with the recesses 2*c* and 2*d*.

When the projections 1*d* and 1*f* are in engagement with the recesses 2*c* and 2*d* as shown in FIG. 8, the operating shaft 2 in this state will be checked from turning if forced to turn.

In the present embodiment, the click mechanism like in the above-described embodiment may be formed by interposing the spring for clicking between the operating shaft 2 and the coding member 11 and mounting the spring for clicking on the coding member 11 or on the operating shaft 2.

Figure 10:
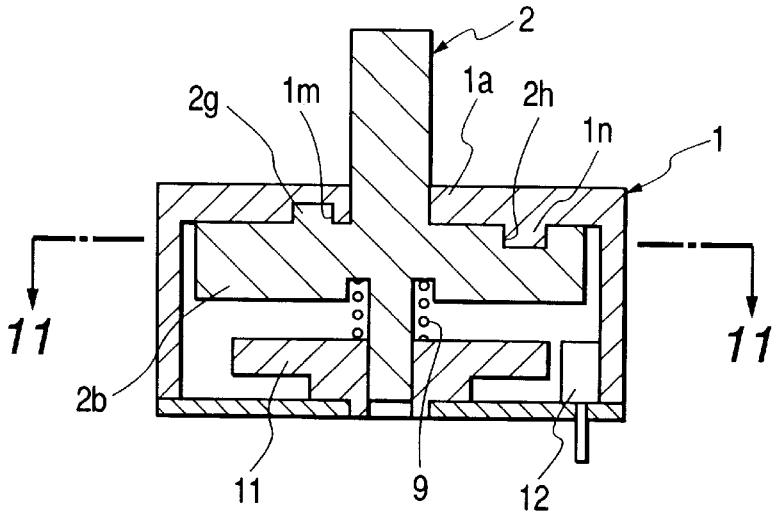
FIG. 10 is a sectional view of the third embodiment.
Figure 11:
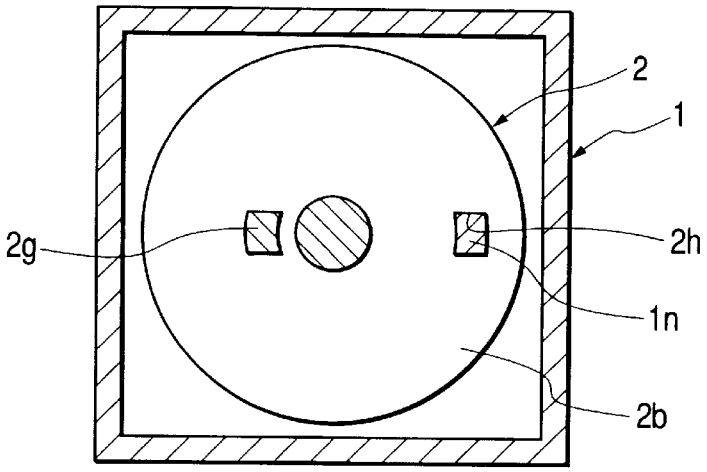
FIG. 11 is a sectional view taken along line 11—11 of FIG. 10.
Figure 12:
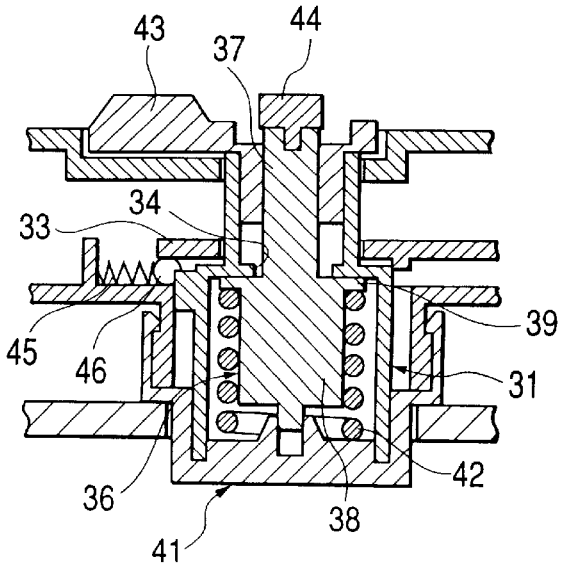
FIG. 12 PRIOR ART
FIG. 12 is a sectional view of a prior art switch
Figure 13:
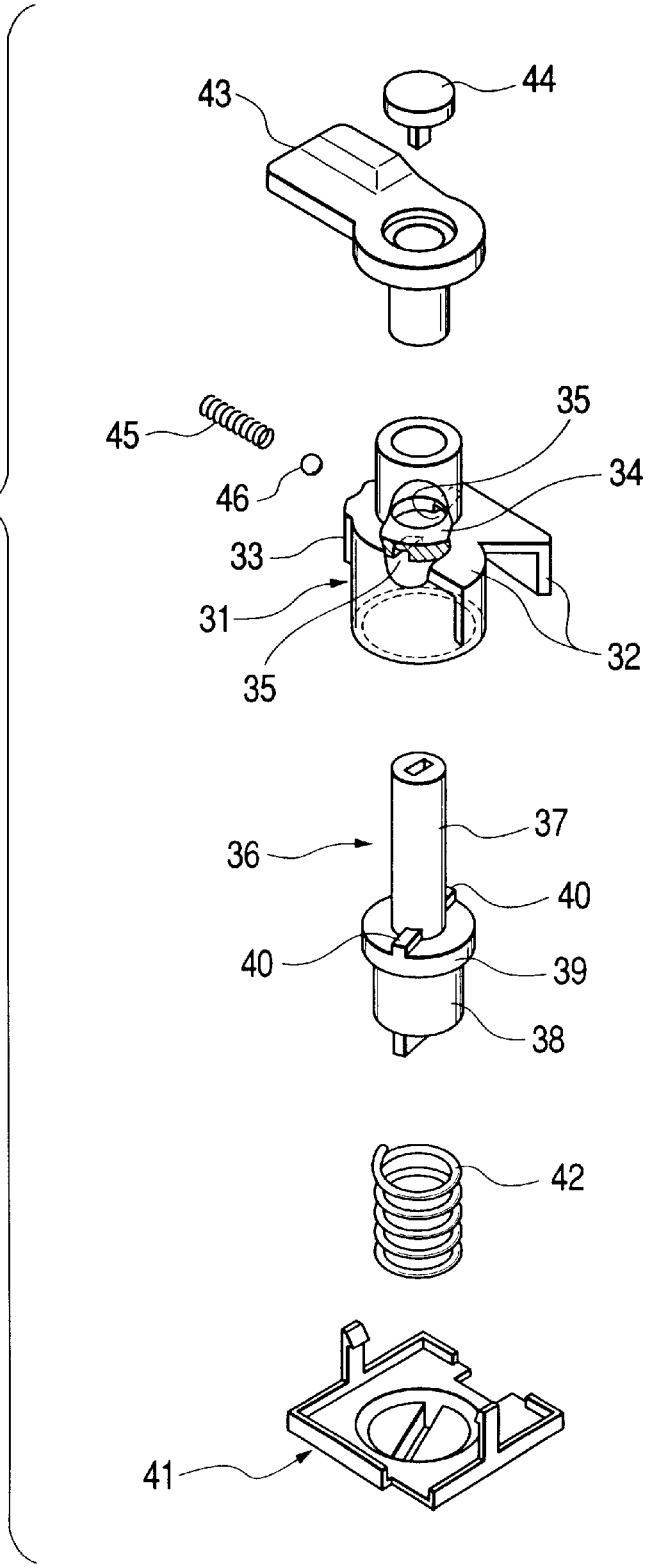
FIG. 13 PRIOR ART
FIG. 13 is an expanded view of the switch of FIG. 12.

FIG. 10 and FIG. 11 show the third embodiment of the rotating electrical component of the present invention. In the present embodiment, the rotary encoder is applied, in which the flange 1*a* of the support member 1 differs in diameter from the center P of rotation of the operating shaft 2, on both sides (in positions 180 degrees apart) of the center P of rotation of the line S1 passing through the center P of rotation of the operating shaft 2, and the projections in are formed in positions not overlapping the recesses 1*m* in the circumferential direction.

The flange 2*b* of the operating shaft 2 is provided with projection 2*g* and the recess 2*h*, which differ in diameter from the center P of rotation of the operating shaft 2, on both sides (in positions 180 degrees apart) of the center P of rotation of the line S1 passing through the center P of rotation of the operating shaft 2, and are not overlapped in the circumferential direction.

The projection 2*g* of the operating shaft 2 can be engaged with, and released from, the recess 1*m* of the support member 1; and also the projection in of the support member 1 can be engaged with, and released from, the recess 2*h* of the operating shaft 2. The electrical component is the same in other points of constitution as the second embodiment; therefore the same members are designated with the same reference numerals and will not be described.

In the present third embodiment, when the operating shaft 2 is axially pushed, the projection 2*g* and the recess 2*h* of the operating shaft 2 are disengaged from the recess 1*m* and the projection in of the support member 1 respectively, to thereby permit rotation of the operating shaft 2. As the operating shaft 2 is turned through 360 degrees, the projection 2*g* and the recess 2*h* of the operating shaft 2 engage with the recess 1*m* and the projection in of the support member 1 respectively; consequently the operating shaft is checked from turning. Other operations are done similarly to the second embodiment and therefore will not be described.

In the second and third embodiments, the electrical component can be made thinner as compared with that of the first embodiment.

In the first to third embodiments, the projections and recesses are provided in two places at intervals of 180 degrees, and may be provided in three places at intervals of 120 degrees not overlapping in the radial direction.

The present invention can provide a rotating electrical component in which the operating shaft is turned after axially moved, and therefore the electrical component will never carelessly be operated.

It is, therefore, possible to provide a rotating electrical component in which the operating shaft 2 is adjustable within a wide range of rotation because of the formation of the projections 1*d* and 1*f* and the recesses 2*c* and 2*d* which differ in diameter from the center P of rotation of the operating shaft 2 and can be mutually engaged and disengaged, on the mating surface sides of the flange 1*a* of the support member 1 and the flange 2*b* of the operating shaft 2, on both sides of the center P of rotation of the line S1 passing through the center P of rotation of the operating shaft 2, and in such positions where the projections and recesses are not overlapped in the circumferential direction.

It is also possible to provide a rotating electrical component in which the operating shaft 2 is adjustable within a wide range of rotation, is simple in constitution and of good productivity, and besides will not tilt during rotation because of the formation of the recesses 2*c* and 2*d* which differ in diameter from the center P of rotation of the operating shaft 2, on either one of the flange 1*a* of the support member 1 and the flange 2*b* of the operating shaft 2, on both sides of the center P of rotation of the line S1 passing through the center P of rotation of the operating shaft 2, and the formation of the projections 1*d* and 1*f*, on the other, which can be engaged with, and disengaged from, the recesses 2*c* and 2*d*.

Furthermore it is possible to provide a rotating electrical component in which the operating shaft 2 is adjustable within a wide range of rotation and will not tilt during rotation because of the formation of the recess 1*m* in one of the positions and the projection in in the other position which differ in diameter from the center P of rotation of the operating shaft 2, on both sides of the center P of rotation of the operating shaft 2, and further the formation, on the flange 2*b* of the operating shaft, of the projections 2*g* which can be engaged with, and disengaged from, the recess 1*m* of the flange 1*a*, and the recess 2*h* which can be engaged with, and disengaged from, the projection 1*n* of the flange 1*a*.

Furthermore it is possible to provide a low-cost rotating electrical component of simple constitution and high productivity because of the unitary formation of the operating shaft 2 and the flange 2*b*.

Furthermore it is possible to provide a rotating electrical component, such as a low-cost variable resistor, switch, etc., which comprises a small components count and accordingly ensures efficient assembling because the spring member 9 for actuating the operating shaft 2 is interposed between the rotating body 3 holding the contact member 10 and the operating shaft 2.

Furthermore it is possible to provide a rotating electrical component with a small click mechanism which has a good space factor because the spring 4 for clicking is interposed between the rotating body 3 and the operating shaft 2.

Furthermore it is possible to provide a rotating electrical component having a small components count which allows efficient assembling, and comprising a low-cost rotary encoder because of the interposition of the spring member 9, for actuating the operating shaft 2, between the coding member 11 and the operating shaft 2.

Furthermore it is possible to provide a rotating electrical component with a small clicking mechanism which has a good space factor because of the disposition of the spring 4 for clicking between the coding member 11 and the operating shaft 2.

What is claimed is:

1. A rotating electrical component, comprising:

a support member having a flange, said flange of said support member having a support member flange surface, an operating shaft rotatably and axially movably mounted on said support member and having a flange, said flange of said operating shaft having a operating shaft flange surface, said operating shaft flange surface being adjacent to said support member flange surface, and a spring member for pressing said operating shaft in a direction so as to bring said support member flange surface into contact with said operating shaft flange surface;

wherein at least two projections are formed on either said support member flange surface or said operating shaft flange surface, said projections being located on different sides of an axis of rotation of said operating shaft, said projections each having a different radius from said axis of said operating shaft so that said projections will not overlap each other in a circumferential direction around said axis of said operating shaft, and further wherein at least two recesses are formed on either said support member flange surface or said operating shaft flange surface, said recesses each having a different radius from said axis of said operating shaft so that said recesses do not overlap each other in the circumferential direction around said axis of said operating shaft, said recesses being located so as to be engageable by said projections to prevent rotation of said operating shaft, and said projections are disengageable from said recesses when said operating shaft is moved axially against the force of said spring member to enabling rotation of said operating shaft.

2. A rotating electrical component according to claim 1, wherein said operating shaft and said flange are unitarily formed by molding a synthetic resin.

3. A rotating electrical component according to claim 1 further comprising a rotating body holding a contact member; said rotating body being splined to said operating shaft so that said rotating body is be rotated by turning said operating shaft; and wherein said spring member is interposed between said operating shaft and said rotating body.

4. A rotating electrical component according to claim 3, wherein a spring for clicking is disposed between said rotating body and said support member, and is attached to said rotating body or to said support member so that said operating shaft will click when rotated.

5. A rotating electrical component, comprising:

a support member having a flange, said flange of said support member having a support member flange surface, an operating shaft rotatably and axially movably mounted on said support member and having a flange, said flange of said operating shaft having a operating shaft flange surface, said operating shaft flange surface being adjacent to said support member flange surface, and a spring member for pressing said operating shaft in a direction so as to bring said support member flange surface into contact with said operating shaft flange surface;

wherein a projection and a recess are formed on said operating shaft flange surface, said projection and said recess being located on different sides of an axis of rotation of said operating shaft, said projection and said recess each having a different radius from said axis of said operating shaft so that said projection and said recess will not overlap each other in a circumferential direction around said axis of said operating shaft, and further wherein a projection and a recess are formed on said support member flange surface, said projection on said support member flange surface being located so to be engageable with said recess on said operating shaft flange surface, and said recess on said support member flange surface being located so to be engageable by said projection on said operating shaft flange surface, said projections being engaged with said recesses to prevent rotation of said operating shaft, and said projections being disengaged from said recesses when said operating shaft is moved axially against the force of said spring member to enabling rotation of said operating shaft.

6. A rotating electrical component according to claim 5, wherein said operating shaft and said flange are unitarily formed by molding a synthetic resin.

7. A rotating electrical component according to claim 5, further comprising a rotating body holding a contact member; said rotating body being splined to said operating shaft so that said rotating body is be rotated by turning said operating shaft; and wherein said spring member is interposed between said operating shaft and said rotating body.

8. A rotating electrical component according to claim 7, wherein a spring for clicking is disposed between said rotating body and said support member, and is attached to said rotating body or to said support member so that said operating shaft will click when rotated.

* * * * *